US006787508B2

(12) United States Patent
Gov

(10) Patent No.: US 6,787,508 B2
(45) Date of Patent: Sep. 7, 2004

(54) LUBRICANT FOR CUTTING THREADS

(76) Inventor: Tea Hor Gov, 5128 S. 168th St., Seattle, WA (US) 98188

( * ) Notice: Subject to any disclaimer, the term of this patent is extended or adjusted under 35 U.S.C. 154(b) by 0 days.

(21) Appl. No.: 10/266,876

(22) Filed: Oct. 7, 2002

(65) Prior Publication Data

US 2004/0067857 A1 Apr. 8, 2004

(51) Int. Cl.[7] ..... C10M 169/06
(52) U.S. Cl. ..... 508/167; 508/168; 508/169; 508/539
(58) Field of Search ..... 508/167, 168, 508/169

(56) References Cited

U.S. PATENT DOCUMENTS 3,661,471 A * 5/1972 Simonffy ..... 408/220
3,801,503 A * 4/1974 Hartmann ..... 508/169
3,844,955 A * 10/1974 Green ..... 508/141
5,015,401 A * 5/1991 Landry et al. ..... 508/169
5,650,380 A * 7/1997 Fletcher ..... 508/168
5,839,311 A * 11/1998 Grenfell et al. ..... 72/42
5,891,830 A * 4/1999 Koltermann et al. ..... 508/136
6,265,357 B1 * 7/2001 Yuan ..... 508/168
6,355,602 B1 * 3/2002 Okaniwa et al. ..... 508/168
6,444,621 B1 * 9/2002 Okaniwa et al. ..... 508/168
6,562,768 B1 * 5/2003 Gregston ..... 508/489

* cited by examiner

*Primary Examiner*—Ellen M. McAvoy
(74) *Attorney, Agent, or Firm*—Black Lowe & Graham PLLC; Mark S. Beaufait

(57) ABSTRACT

The present invention provides a substance for lubricating cutting tools, the substance preferably comprising grease and tapping fluid. The grease may include lithium and the tapping fluid may include molybdenum. The substance made from two to six parts of grease per one part tapping fluid.

23 Claims, 2 Drawing Sheets

LUBRICANT FOR CUTTING THREADS

FIELD OF THE INVENTION

This invention relates generally to lubricants and, more specifically, to lubricants for cutting threads.

BACKGROUND OF THE INVENTION

Heat-treated and hardened metal cutting tools, commonly either taps or dies, are used to cut threads. Lubricants are commonly used in this cutting process, In many instances, the cutting fluid is a liquid tapping fluid, often containing molybdenum.

The tapping fluids used for thread cutting are often thin fluids that run off the cutting tool and the work, reducing the amount of lubricant available at the actual working surface. A reduced amount of tapping fluid or lubricant in the areas of cutting results in increased friction and wear, decreasing the working life of the cutting tools.

Therefore, there is an unmet need for a cutting tool lubricant that stays in contact with working surfaces, and provides better lubrication to cutting tools.

SUMMARY OF THE INVENTION

The present invention provides a substance for lubricating cutting tools, the substance comprising a thickening agent such as grease and tapping fluid. The grease may include lithium and the tapping fluid includes molybdenum. The substance is preferably made from two to six parts of grease per one part tapping fluid.

BRIEF DESCRIPTION OF THE DRAWINGS

The preferred and alternative embodiments of the present invention are described in detail below with reference to the following drawings.

DETAILED DESCRIPTION OF THE INVENTION

By way of background, the present invention provides a substance for lubricating cutting tools, the substance comprising a thickening agent such as grease and tapping fluid. The grease may include lithium and the tapping fluid may include molybdenum. The substance is preferably made from two to six parts of grease per one part tapping fluid.

Figure 1:
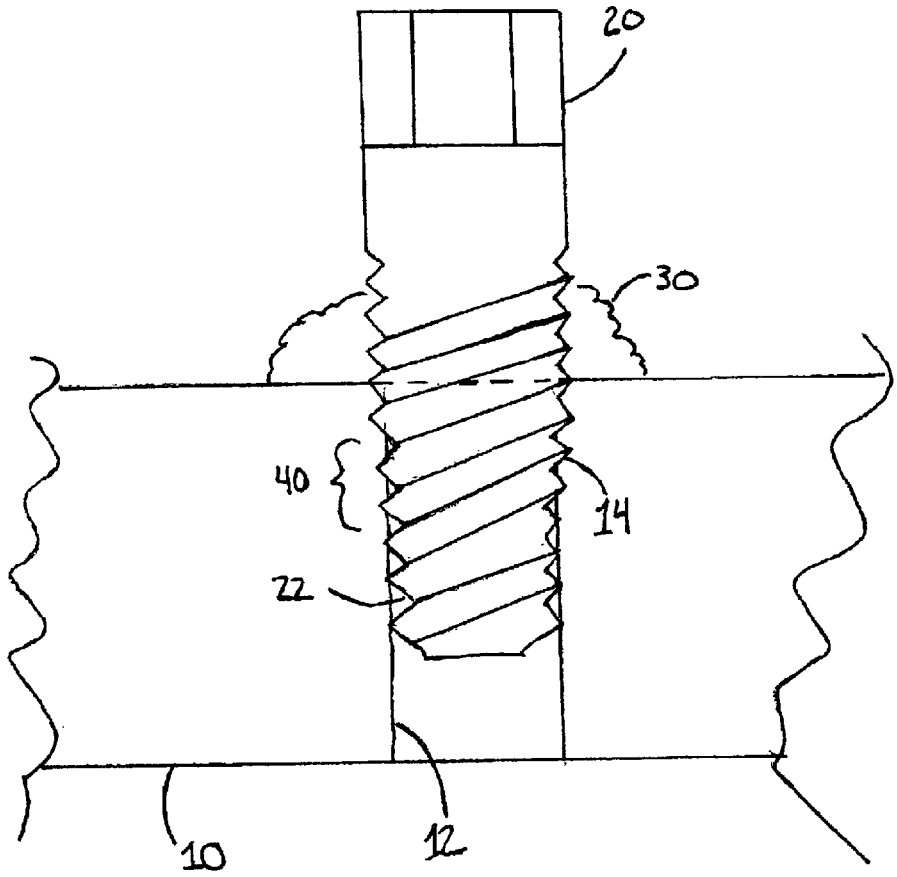
FIG. 1 is a cross section of a tap cutting threads in a work piece.

FIG. 1 is a cross section of a tap 20 being used to cut threads 14 in a work piece 10. The tap 20 is inserted into a hole 12 drilled through the work piece 10. As the tap 20 is turned into the hole 12, threads 14 are cut by the cutting threads 22 of the tap 20. To lubricate the thread cutting process, the substance or lubricant 30 of the present invention is applied to the tap 20 and the work piece 10 lubricating the tap 20 as it cuts the threads 14. The lubricant of the present invention acts as a gel, and thus does not run off the tap 20 and the work piece 10 as it would if the lubricant 30 were a thin fluid. Because the lubricant 30 does not run off the tap 20 or the work piece 10, it is available to be drawn into the cutting area 40 where the threads 14 are being cut by the tap 20 in the work piece 10.

In the art it is common to use tapping fluid when tapping a hole or using a die to thread rod stock. Tapping fluids are typically designed to resist cutting pressures, reducing wear on the cutting tools. Forces at the point of cutting are very high, and may exceed the yield point of the hardened metal or heat-treated cutting tools, resulting in wear. The use of a tapping fluid reduces wear thereby lengthening the working life of the cutting tool.

The present invention is a lubricant that includes a tapping fluid mixed with a grease. The grease includes a general-purpose grease such as that used for automotive, industrial and construction equipment. In an exemplary embodiment of the present invention, the grease is a lithium general-purpose grease containing heavy mineral oil and lithium in the form of a lithium soap. The tapping fluid is a molybdenum bearing tapping fluid. In an exemplary embodiment the molybdenum bearing tapping fluid, such as Castrol "Moly-Dee," includes chlorinated paraffin, lard oil, polysulfide, petroleum oil, molybdenum disulfide, and a corrosion inhibitor.

The mixture of grease and tapping fluid forms a gel that sticks to the cutting tool and the work piece and does not flow like a thin fluid at ordinary room temperatures. The mixture includes two to six parts grease to one part tapping fluid. In the preferred embodiment, the mixture comprises four parts grease to one part tapping fluid.

The mixture of the tapping fluid and the lithium grease has been found to increase the working life of the cutting tool by several times. In one exemplary embodiment of the invention, four parts of lithium general-purpose grease are mixed with one part of Castrol "Moly-Dee" tapping fluid. This mixture has been found to yield an increased cutting tool life of approximately six times. The substance formed by mixing the grease and the tapping fluid is less messy to work with than standard liquid tapping fluid which runs off the work. In FIG. 1, the lubricant 30 is the mixture of the tapping fluid and grease, which, acting as a gel, mounds up around the cutting tool, the tap 20.

It will be appreciated that the substance of the present invention may be suitably utilized in many cutting applications including, tapping, threading, drilling, and reaming metals including aluminum and difficult to machine metals.

Figure 2:
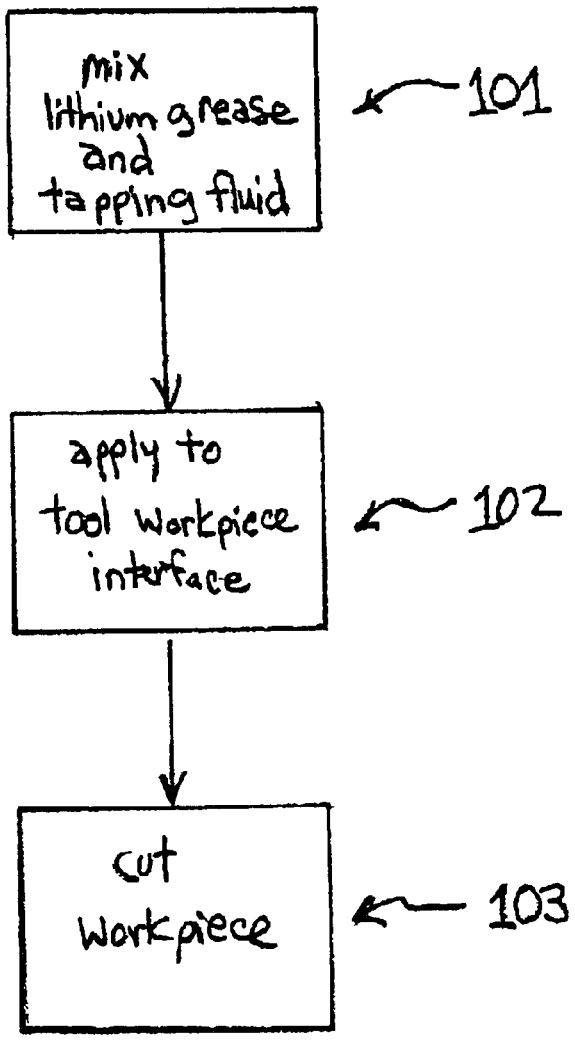
FIG. 2 is a schematic drawing of a method of cutting threads using the present invention.

FIG. 2 illustrates the method of the present invention utilized to cut threads. In an exemplary embodiment, the first step of the method is to mix lithium grease and tapping fluid 102. In this embodiment, four parts of grease are mixed with one part tapping fluid. The second step of the method is to apply the mixture 102 to the tool/work piece interface, and the third step of the method is to cut the work piece 103.

It will be appreciated that the grease and tapping fluid may be mixed in any suitable fashion. Quantities of the mixture may be pre-made prior to use, or mixing may be done manually at the work piece tool interface with the grease and tapping fluid applied separately and mixed together.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A substance for lubricating cutting tools comprising:

a grease including a first oil; and a tapping fluid including a second oil.

2. The substance of claim 1, wherein the grease includes lithium.

3. The substance of claim 1, wherein the tapping fluid includes molybdenum.

4. The substance of claim 1 wherein the substance includes from 2 to 6 parts of grease per 1 part tapping fluid.

5. The substance of claim 4 wherein the substance includes 4 parts of grease per 1 part tapping fluid.

6. A substance for lubricating cutting tools comprising:

lithium general purpose grease; and molybdenum bearing tapping fluid.

7. The substance of claim 6 wherein the substance includes from 2 to 6 parts of grease per 1 part tapping fluid.

8. The substance of claim 7 wherein the substance includes 4 parts of grease per 1 part tapping fluid.

9. A method for cutting threads comprising:

applying a mixture of grease and a tapping fluid to a cutting tool; and cutting threads.

10. The method of claim 9, wherein the grease includes lithium.

11. The method of claim 9, wherein the tapping fluid includes molybdenum.

12. The method of claim 9, wherein the mixture includes from 2 to 6 parts of grease per 1 part tapping fluid.

13. The method of claim 12, wherein the mixture includes 4 parts of grease per 1 part tapping fluid.

14. The method of claim 9, further comprising mixing the grease and tapping fluid before the step of applying.

15. A substance for lubricating cutting tools comprising:

a molybdenum bearing tapping fluid including molybdenum and at least one petroleum oil; and a thickening agent, wherein the mixture of the tapping fluid and thickening agent form a gel.

16. The substance of claim 15, wherein the thickening agent comprises grease.

17. The substance of claim 16, wherein the grease comprises lithium.

18. The substance of claim 1, wherein the first oil includes a petroleum oil.

19. The substance of claim 1, wherein the second oil includes a mineral oil.

20. The substance of claim 6, wherein the molybdenum bearing tapping fluid includes a first oil.

21. The substance of claim 20, wherein the molybdenum bearing tapping fluid includes a petroleum oil.

22. The substance of claim 17, wherein the grease includes a second oil.

23. The method of claim 9, wherein the tapping fluid includes at least one petroleum oil.

* * * * *